US011788224B2

(12) United States Patent
Jung et al.

(10) Patent No.: US 11,788,224 B2
(45) **Date of Patent: *Oct. 17, 2023**

(54) LAUNDRY TREATING APPARATUS

(71) Applicant: LG ELECTRONICS INC., Seoul (KR)

(72) Inventors: Sungwoon Jung, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/939,583

(22) Filed: Sep. 7, 2022

(65) Prior Publication Data

US 2023/0002951 A1 Jan. 5, 2023

Related U.S. Application Data

(62) Division of application No. 16/749,583, filed on Jan. 22, 2020, now Pat. No. 11,459,690.

(30) Foreign Application Priority Data

Jan. 22, 2019 (KR) ..... 10-2019-0008282

(51) Int. Cl.
*D06F 39/02* (2006.01)
*D06F 39/08* (2006.01)
(Continued)

(52) U.S. Cl.
CPC ..... *D06F 39/02* (2013.01); *D06F 37/28* (2013.01); *D06F 39/088* (2013.01); *D06F 21/04* (2013.01); *D06F 2105/42* (2020.02)

(58) Field of Classification Search
None
See application file for complete search history.

(56) References Cited

U.S. PATENT DOCUMENTS

2011/0277515 A1 11/2011 Doh
2014/0075684 A1 3/2014 Kim et al.
(Continued)

FOREIGN PATENT DOCUMENTS

DE 112005000830 3/2020
DE 112005000831 3/2020
(Continued)

OTHER PUBLICATIONS

Office Action in German Appln. No. 102020200481, dated Mar. 30, 2022, 13 pages (with English translation).
(Continued)

*Primary Examiner* — Cristi J Tate-Sims
(74) *Attorney, Agent, or Firm* — Fish & Richardson P.C.

(57) ABSTRACT

The present disclosure relates to a laundry treating apparatus, including a tub provided inside a main body and a drum rotatably provided inside the tub; and a detergent supply apparatus provided to be inserted into or withdrawn from a front surface of the main body, and configured to supply laundry detergent to the tub, wherein the detergent supply apparatus includes a laundry detergent input pipe that allows laundry detergent being moved by the laundry detergent pump to pass through an upper portion of the wash water dispenser so as to flow into the housing through the wash water dispenser.

20 Claims, 9 Drawing Sheets

(51) Int. Cl.

| | |
|---|---|
| ***D06F 37/28*** | (2006.01) |
| *D06F 105/42* | (2020.01) |
| *D06F 21/04* | (2006.01) |

(56) References Cited

U.S. PATENT DOCUMENTS

| | | | | |
|---|---|---|---|---|
| 2015/0252514 | A1* | 9/2015 | Seo | D06F 33/37 68/17 R |
| 2016/0194813 | A1 | 7/2016 | Kurtkaya et al. | |
| 2016/0215434 | A1* | 7/2016 | Doyle | D06F 39/022 |
| 2017/0073875 | A1* | 3/2017 | Seo | D06F 39/028 |
| 2017/0268151 | A1 | 9/2017 | Leibman et al. | |

FOREIGN PATENT DOCUMENTS

| | | |
|---|---|---|
| KR | 10-0556482 | 3/2006 |
| KR | 10-2010-0055214 | 5/2010 |

OTHER PUBLICATIONS

Office Action in Korean Appln. No. 10-2019-0008282, dated Jun. 17, 2023, 10 pages (with English translation).

* cited by examiner

LAUNDRY TREATING APPARATUS

CROSS-REFERENCE TO RELATED APPLICATION

This application is a divisional of U.S. patent application Ser. No. 16/749,583, filed on Jan. 22, 2020, now U.S. Pat. No. 11,459,690, which pursuant to 35 U.S.C. § 119(a), claims the benefit of an earlier filing date of and the right of priority to Korean Patent Application No. 10-2019-0008282, filed on Jan. 22, 2019, the contents of which are incorporated by reference herein in their entirety.

BACKGROUND

1. Technical Field

The present disclosure relates to a laundry treating apparatus having a detergent supply apparatus.

2. Description of the Related Art

The laundry treating apparatus is an apparatus for putting clothing, bedding or the like (hereinafter, referred to as laundry) into the drum to remove contamination from the laundry. The laundry treating apparatus may perform the processes of washing, rinsing, dehydrating, drying and the like, and the laundry treating apparatus may be divided into a top loading type and a front loading type based on a method of putting laundry into a drum.

The laundry treating apparatus may generally include a main body defining an outer appearance, a tub received into the main body, a drum rotatably mounted inside the tub to put laundry thereinto, and a detergent supply apparatus for supplying detergent into the drum. When the drum is rotated by the motor while water is supplied to the laundry received in the drum, dirt adhered to the laundry may be removed by a friction with the drum and the water.

The detergent supply apparatus is provided with a laundry detergent supply function of supplying detergent or laundry detergent (hereinafter, referred to as "laundry detergent") to enhance the washing effect.

Here, the laundry detergent means a substance that enhances the washing effect, such as textile detergent, fabric softener, and fabric bleach. For the laundry detergent, powder type laundry detergent or liquid type laundry detergent may be used.

In recent years, there is a problem in that the detergent component is not dissolved after washing and remains in the water tank or the laundry, and thus, the use of liquid laundry detergent with excellent solubility instead of powder type laundry detergent is gradually increased.

A laundry treating apparatus in the related art has inconvenience because it is mainly used a method of allowing the user to open a door and then to manually put laundry detergent in a detergent storage container provided inside the door so as to supply the laundry detergent and then to add the laundry detergent directly injected by the user to the tub by way of water supplied through a water passage.

Accordingly, in order to automatically supply a large amount of laundry detergent stored in a detergent supply apparatus according to the washing process, it may be considered to supply the laundry detergent toward a rear portion of the detergent supply apparatus, but in this case, a movement distance of laundry detergent may increase to cause difficulty in more efficiently supplying laundry detergent, and there is a problem that requires an additional water supply valve for adding laundry detergent.

SUMMARY

A first aspect of the present disclosure is to provide a structure of a laundry treating apparatus capable of storing a large amount of laundry detergent in a detergent supply apparatus and automatically supplying the stored laundry detergent to a drum.

A second aspect of the present disclosure is to provide a structure of a laundry treating apparatus capable of more efficiently supplying laundry detergent by changing a movement path of laundry detergent to supply laundry detergent toward a position adjacent to a detergent input hole and a tub so as to reduce a movement distance of laundry detergent.

A third aspect of the present disclosure is to provide a structure of a laundry treating apparatus having a simpler structure of a rear portion of the detergent supply apparatus.

In order to achieve an object of the present disclosure, a laundry treating apparatus having the foregoing structure may include a tub provided inside a main body and a drum rotatably provided inside the tub; and a detergent supply apparatus provided to be inserted into or withdrawn from a front surface of the main body, and configured to supply laundry detergent to the tub, wherein the detergent supply apparatus includes a housing defining an outer appearance, and a storage container disposed to extend in a front-rear direction of the main body to store the laundry detergent, and mounted to the housing; a laundry detergent pump provided at a rear portion of the housing to define a movement of laundry detergent stored in the storage container; a water dispenser fixedly provided inside the main body to allow a bottom portion thereof to face an upper portion of the storage container so as to define a movement of water flowing in from the outside; and a laundry detergent input pipe that allows laundry detergent being moved by the laundry detergent pump to pass through an upper portion of the water dispenser so as to flow into the housing through the water dispenser.

According to an example of the present disclosure, one end of the laundry detergent input pipe may be connected to the laundry detergent pump, and the other end thereof may be configured to communicate with an inside of the housing so as to supply laundry detergent received in the storage container to the tub.

According to an example of the present disclosure, a first storage container and a second storage container may be mounted to face each other at an inside of the housing, and a manual detergent dispensing unit may be disposed between the first storage container and the second storage container to allow a user to manually put laundry detergent therein.

According to an example of the present disclosure, the laundry detergent input pipe may supply laundry detergent toward the manual detergent input unit, and laundry detergent may be discharged from the water dispenser and mixed with water flowing into the housing, and then moved toward the tub.

According to an example of the present disclosure, a third detergent container configured to guide the input of laundry detergent by the user may be mounted to the manual detergent dispensing unit.

According to an example of the present disclosure, a discharge port may be disposed at a rear portion of the storage container to allow laundry detergent to be discharged by the operation of the laundry detergent pump.

Furthermore, laundry detergent moving through the discharge port may move along the laundry detergent input pipe to be mixed with water flowing into the housing, and then moved toward the tub.

According to an example of the present disclosure, the water dispenser may include a dispenser cover disposed with a water passage in a predetermined shape along the surface to guide a movement of water flowing in along a water inlet pipe; and a dispenser lid coupled to cover an upper portion of the dispenser cover.

According to an example of the present disclosure, a water receiving protrusion disposed to protrude upward so as to receive water may be disposed at one upper side of the dispenser lid.

According to an example of the present disclosure, a detergent inlet portion vertically passing through the dispenser cover may be disposed at one upper side of the dispenser cover, and the laundry detergent input pipe may be coupled to an outside of the detergent inlet portion.

According to an example of the present disclosure, a water inlet pipe may be disposed at a rear end portion of the dispenser cover to communicate the inside and the outside so as to allow water to flow therein.

According to an example of the present disclosure, the laundry detergent input pipe may be provided to pass through an upper portion of the dispenser cover.

According to an example of the present disclosure, a lower surface of the housing may be disposed to have a predetermined inclination for the movement of laundry detergent, and a detergent input hole may be disposed on the lower surface of the housing to communicate with the tub.

According to an example of the present disclosure, a lower side portion of the housing may be disposed to be inclined toward the detergent input hole.

The effects of the present disclosure obtained through the above-described solutions are as follows.

First, the detergent supply apparatus may be mounted with storage containers for storing different laundry detergent, respectively, to store a large amount of laundry detergent. Furthermore, it may be possible to automatically supply an appropriate amount of laundry detergent to the tub through the operation of the laundry detergent pump in the washing process, and if necessary, the user may directly put a desired amount of laundry detergent into the manual detergent dispensing unit, thereby further enhancing the user's convenience.

Second, it may be possible to supply laundry detergent toward a position adjacent to the detergent input hole and the tub by changing a movement path of laundry detergent, thereby more efficiently supplying laundry detergent.

Third, laundry detergent flowing out of the laundry detergent pump may not be supplied to a side portion of the housing, and thus a rear structure of the detergent supply apparatus may be more simplified, thereby allowing the simplification of the assembly process. In addition, after the user withdraws the housing, easily removing the storage container provided in the housing may be facilitated.

BRIEF DESCRIPTION OF THE DRAWINGS

FIG. 7 is cross-sectional view showing an inner appearance of the detergent inlet portion disposed at the dispenser lid, as a cross-sectional view in which FIG. 6 is cut in a transverse direction.

DETAILED DESCRIPTION OF THE EMBODIMENTS

Hereinafter, a laundry treating apparatus associated with the present disclosure will be described in more detail with reference to the accompanying drawings.

According to the present specification, the same or similar elements are designated with the same numeral references even in different embodiments and their redundant description will be omitted.

Furthermore, a structure applied to any one embodiment may be also applied in the same manner to another embodiment if they do not structurally or functionally contradict each other even in different embodiments.

A singular representation may include a plural representation as far as it represents a definitely different meaning from the context.

In describing the embodiments disclosed herein, the detailed description will be omitted when specific description for publicly known technologies to which the invention pertains is judged to obscure the gist of the present disclosure.

It should be understood that the accompanying drawings are merely illustrated to easily explain the concept of the invention, and therefore, they should not be construed to limit the technological concept disclosed herein by the accompanying drawings, and the concept of the present disclosure should be construed as being extended to all modifications, equivalents, and substitutes included in the concept and technological scope of the invention.

Figure 1:
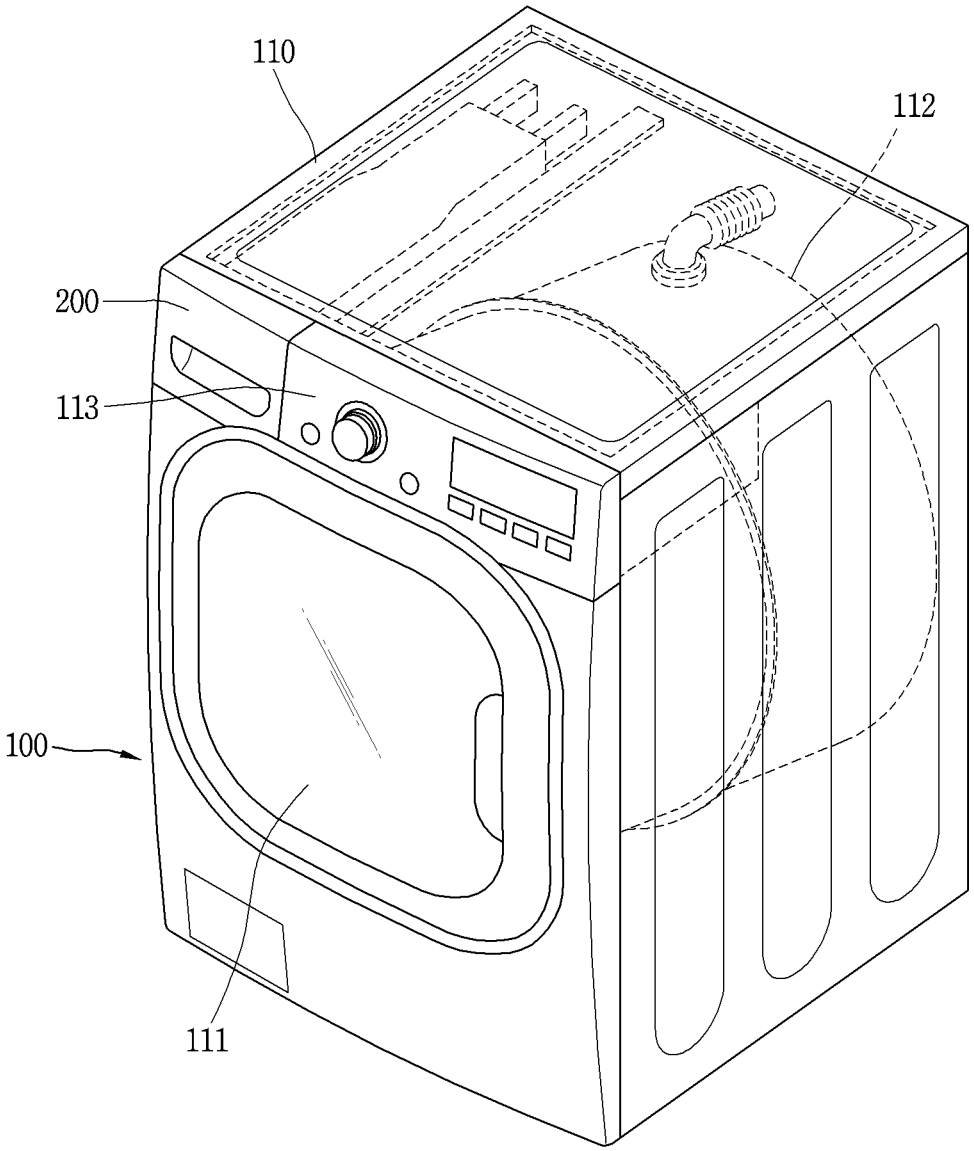
FIG. 1 is a perspective view illustrating a laundry treating apparatus according to the present disclosure.

FIG. 1 is a perspective view illustrating a laundry treating apparatus according to the present disclosure.

The laundry treating apparatus 100 may include a washing machine for inserting fabric into a washing tub to perform washing, rinsing, dehydration, and the like and a dryer for inserting wet fabric to perform drying.

The laundry treating apparatus may be divided into a top load type and a front load type. FIG. 1 illustrates a front load type laundry treating apparatus, for the sake of convenience of explanation, and the technical concept of the present disclosure may not be applicable only to a front load type washing machine, and thus may also be applicable to a top load type washing machine.

As shown in FIG. 1, the laundry treating apparatus 100 has a structure including a main body 110 defining an outer appearance, an operation unit 113 that receives various control commands from a user and has a display unit displaying information on an operation state, and a door 111 rotatably provided at a front portion of the main body 110 to allow the entry and exit of laundry.

The main body 110 may define an outer appearance of the laundry treating apparatus 100, and may be provided with a space capable of receiving various components constituting the laundry treating apparatus 100 inside the main body 110. A drum 112 that receives laundry loaded through the door 111 may be provided inside the main body 110.

The drum 112 may include an outer tub (not shown) filled with water, and an inner tub (not shown) provided to be rotatable inside the outer tub (not shown) to receive laundry. One side of the drum 112 may be provided with a balancer (not shown) to compensate for eccentricity caused by rotation.

The operation unit 113 may include various keys for operating the operation state of the laundry treating apparatus 100 and a display for displaying the operation state of the laundry treating apparatus 100.

The door 111 is to open and close a fabric entrance hole, and may be made of a transparent member such as tempered glass to look inside the main body 110.

The laundry treating apparatus 100 according to the present disclosure may further include a detergent supply apparatus 200.

The detergent supply apparatus 200 may be provided to be inserted into or withdrawn from one upper side of the main body 110. The detergent supply apparatus 200 may store laundry detergent having a broader concept including detergent and fabric softener to automatically supply the laundry detergent into the drum 112 in the washing process. Here, the laundry detergent denotes a material capable of enhancing the washing effect of laundry, and may denote liquid fabric detergent and liquid fabric softener.

Figure 2:
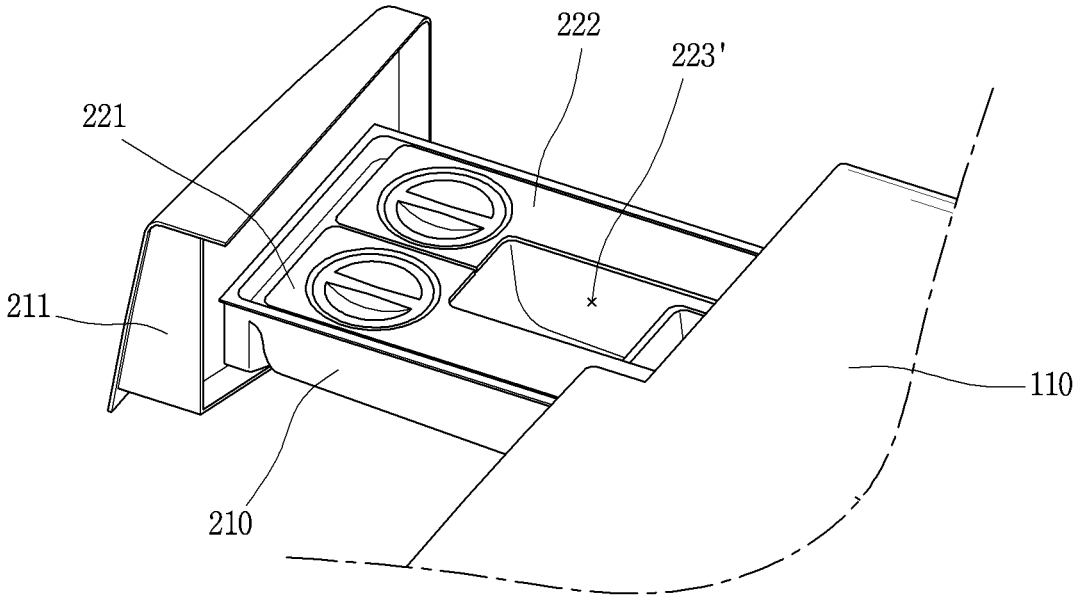
FIG. 2 is a conceptual view showing a state when a detergent supply apparatus is withdrawn from a main body.

FIG. 2 is a conceptual view illustrating a state in which the detergent supply apparatus 200 is withdrawn from the main body 110. The detergent supply apparatus 200 may include a storage case 210 and storage containers 221, 222 mounted to the storage case 210. When the user grips a front portion 211 of the storage case 210 and then pulls it out, the detergent supply apparatus 200 may be withdrawn out in a sliding manner from a front portion of the main body 110. Similarly, when the user pushes the front portion of the storage case 210 toward the main body 110, the detergent supply apparatus 200 may be inserted into the main body 110 while sliding in a direction toward the main body.

However, in order for the user to withdraw the detergent supply apparatus 200 from the main body to replenish laundry detergent in the storage containers 221, 222 or to supply laundry detergent to a manual detergent dispensing unit 223', the plugs 224 of the storage containers 221, 222 and the manual detergent dispensing unit 223' must be made to be exposed to the outside when the detergent supply apparatus 200 is withdrawn from the main body.

The first storage container 221 and the second storage container 222 configured to store different laundry detergents may be mounted inside the storage case 210. In addition, the manual detergent dispensing unit 223' manually supplying laundry detergent by a user may be disposed between the first storage container 221 and the second storage container 222.

The plugs 224 may be provided in the first storage container 221 and the second storage container 222, respectively. The plugs 224 may be removed from the storage containers 221, 222 when rotated in one direction. When the plugs 224 are removed from the storage containers 221, 222, the user will be able to supply laundry detergent to the storage containers 221, 222.

In other words, when a lack of laundry detergent is sensed on the operation panel 113 of the laundry treating apparatus 100, the storage case 210 is withdrawn out, and then the plugs 224 coupled to the storage containers 221, 222 exposed to the outside are gripped, and then removed by rotating them in one direction to replenish the laundry detergent in the storage containers 221, 222.

Figure 3A:
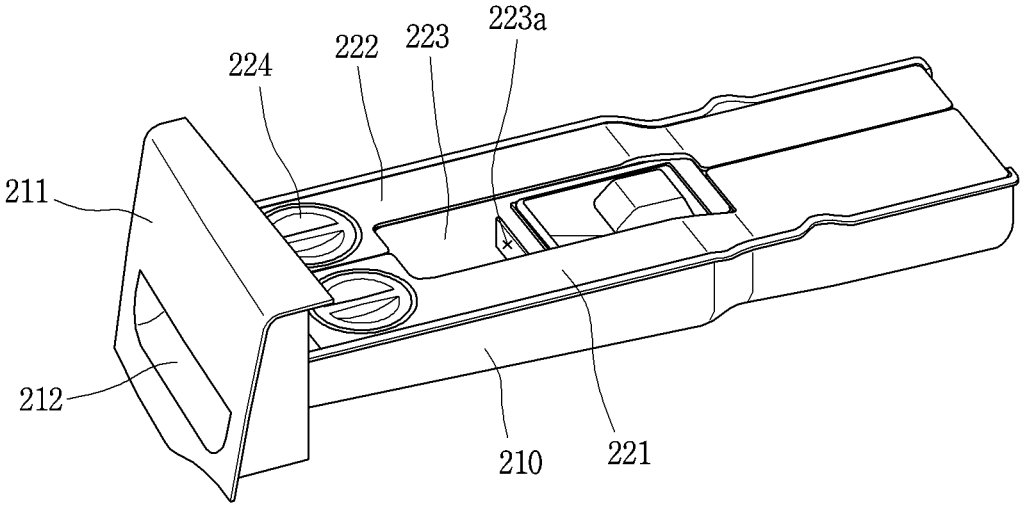
FIG. 3A is a perspective view showing a state in which the detergent supply apparatus is completely withdrawn out to the outside.
Figure 3B:
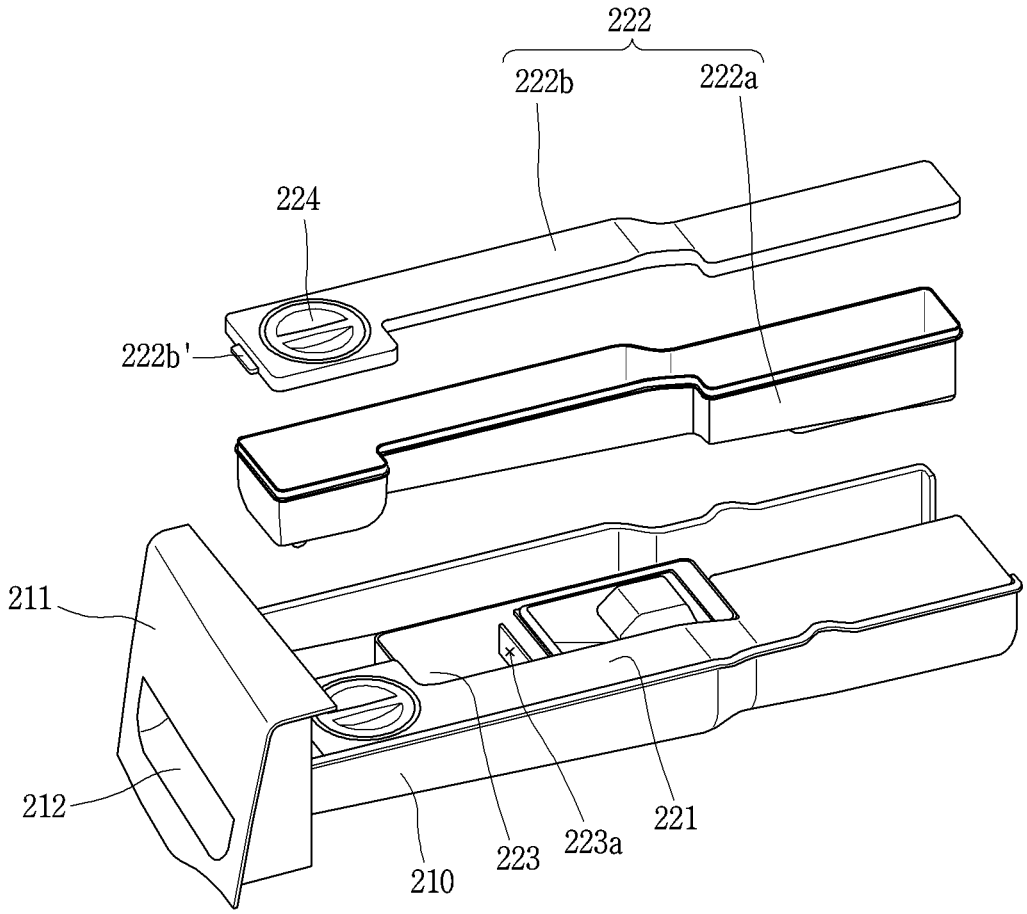
FIG. 3B is an exploded perspective view of the detergent supply apparatus in FIG. 3A.

FIG. 3A is a perspective view showing a state in which the detergent supply apparatus is completely withdrawn out to the outside, and FIG. 3B is an exploded perspective view of the detergent supply apparatus in FIG. 3A.

The detergent supply apparatus 200 may be made to be withdrawn from or inserted into the main body 110 by the user. When the user grips the front portion 211 of the storage case 210 and then pulls it out, the detergent supply apparatus 200 may be withdrawn out while sliding from the front part of the main body 110. When the detergent supply apparatus 200 is withdrawn from the main body 110, the storage containers 221, 222 may be exposed to the outside.

The detergent supply apparatus 200 may include a storage case 210 and storage containers 221, 222 mounted to the storage case 210.

A housing 201 defines an outer appearance of the detergent supply apparatus 200, and may be defined in a shape that is open at an upper end thereof. The storage case 210 and the housing 201 may be defined in a shape extending in a front-rear direction of the main body 110, and a plurality of storage containers 221, 222 may be mounted in a receiving space defined inside the storage case 210.

The storage containers 221, 222 may include a first storage container 221 and a second storage container 222. The first storage container 221 and the second storage container 222 may be defined in a shape of a container extending in a front-rear direction of the main body 1110, and provided with a space capable of storing a predetermined amount of laundry detergent therein.

The first storage container 221 and the second storage container 222 may be defined in a "⊏"-shape, and the first storage container 221 and the second storage container 222 may be mounted inside the storage case 210 in a shape facing each other.

Different laundry detergents may be stored inside the first storage container 210 and the second storage container 220. For example, fabric softener may be stored in the first storage container 210 and liquid detergent may be stored in the second storage container 220, respectively.

A lower surface of the first storage container 221 and the second storage container 222 may be disposed have a predetermined inclination, thereby facilitating the flow of the laundry detergent received in each of the storage containers 221, 222. The laundry detergent stored in each of the storage containers 221, 222 must be supplied toward the tub through the laundry detergent pump 230, it may be disposed to be inclined with a constant inclination toward the rear side.

Each of the storage containers 221, 222 may include a receiving portion 221*a*, 222*a* in which laundry detergent is received and a storage container lid portion 221*b*, 222*b* configured to cover each receiving portion 221*a*, 222*a* to limit an external exposure of the laundry detergent. Furthermore, the storage container lid portion 221*b*, 222*b* may be provided with the foregoing plug 224 to allow the user to replenish laundry detergent through the removal of the plug 224 without removing the storage container lid portion 221*b*, 222*b*. In addition, a front end of each of the storage container cover portion 221*b*, 222*b* may be disposed with a protrusion 222*b'* configured to protrude toward the front portion, thereby allowing the user to hold it to more easily remove the storage container cover portion 221*b*, 222*b*.

Moreover, as shown in FIG. 3A, the first storage container 210 and the second storage container 220 may be mounted at one side of the storage case 210 or the housing 201 to face each other, and thus the manual detergent dispensing unit 223' may be disposed between the first storage container 210 and the second storage container 220, thereby allowing the user to manually put laundry detergent therein.

Besides, the manual detergent dispensing unit 223' may be configured to mount a third storage container 223 so as to guide the input of laundry detergent by the user, and the third storage container 223 may be divided into two regions through a boundary portion defined at a center portion thereof, thereby allowing the user to put fabric softener to one side, and to put detergent to the other side as a manual mode.

Figure 4A:
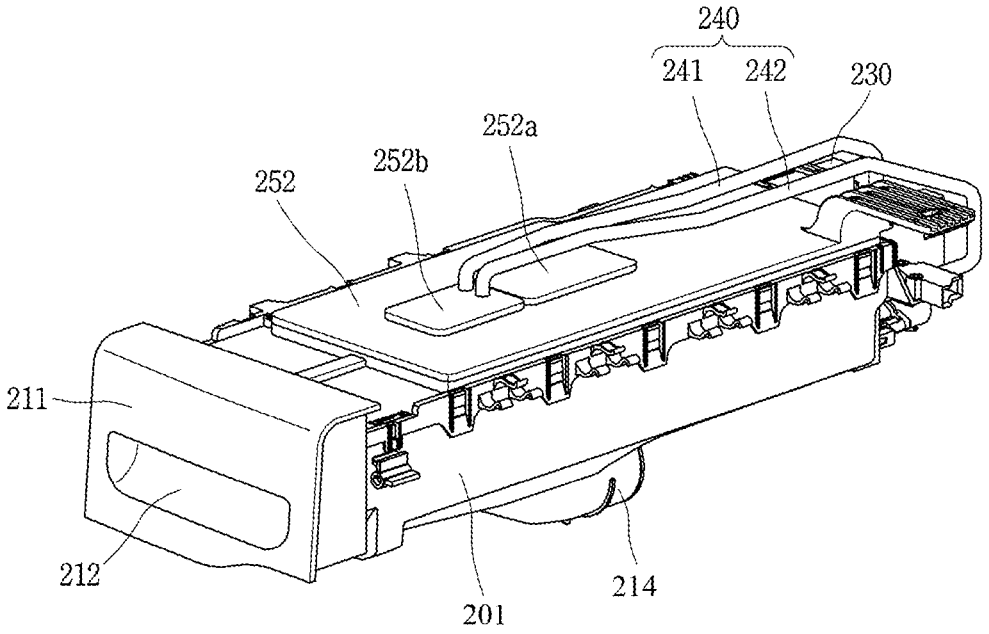
FIG. 4A is a conceptual view showing a state in which the detergent supply apparatus is inserted into the main body.
Figure 4B:
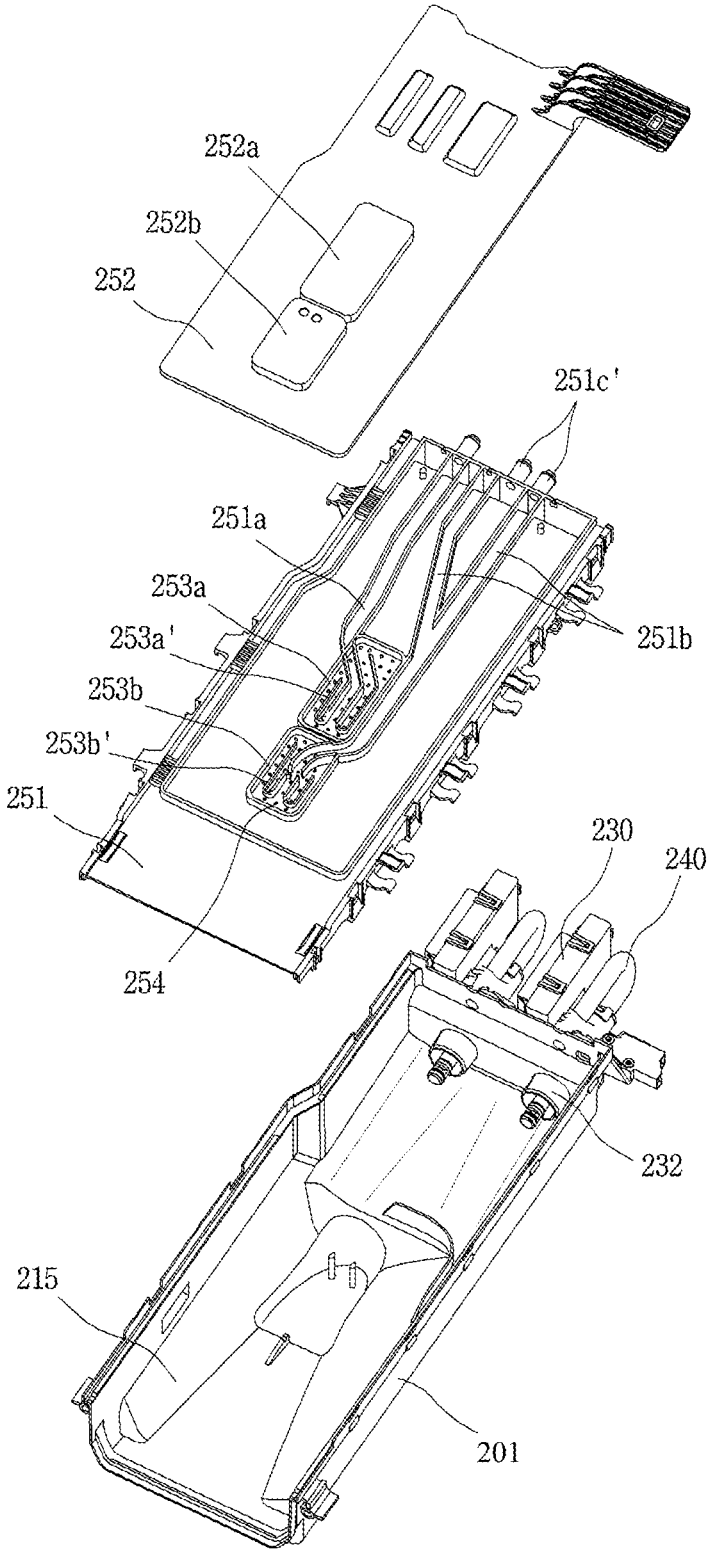
FIG. 4B is an exploded view of the detergent supply apparatus in a state where a storage container is removed in FIG. 4A.

FIG. 4A is a conceptual view showing a state in which the detergent supply apparatus 200 is inserted into the main body 110, and FIG. 4B is an exploded view of the detergent supply apparatus 200 in a state where the storage containers 221, 222 are removed in FIG. 4A.

A water dispenser 250 may be fixedly provided at the main body 110 of the laundry treating apparatus 100. When the storage case 210 is inserted into the main body, the water dispenser 250 may be located above the storage case 210 to have the structure of FIG. 4A.

The water dispenser 250 serves to define a moving path of water flowing therein. When the storage case 210 is mounted to the main body 110, the water dispenser 250 provided inside the main body 110 may be located to face each storage container 221, 222 mounted to the storage case 210.

The water dispenser 250 may include a dispenser cover 251 and a dispenser lid 252 disposed to cover the dispenser cover 251.

The dispenser cover 251 may be disposed with water passages 251*a*, 251*b* extending in a predetermined shape along the surface to guide the movement of water flowing in along a water inlet portion 251*c*, 251*c'*.

The water passages 251*a*, 251*b* may be disposed on a rear surface of the dispenser cover 251 to communicate with the water inlet portions 251*c*, 251*c'* passing through the inside and the outside so as to allow water to flow therein. The water passages 251*a*, 251*b* may be defined by both sidewalls extending along one direction at a predetermined height. When the dispenser lid 252 is coupled to the dispenser cover 251, it may be defined a closed space allowing water to move, thereby allowing water to move toward each water receiving portion 253*a*, 253*b* along the water passage 251*a*, 251*b*.

As shown in FIG. 4B, the water passages 251*a*, 251*b* may be configured in plurality. Each of the water passages 251*a*, 251*b* may extend toward each of the water receiving portions 253*a*, 253*b* disposed at one side surface of the dispenser cover 251.

The water passage 251*a*, 251*b* may include a first water passage 251*a* and a second water passage 251*b*. The first water passage 251*a* may communicate with one water inlet portion 251*c* to allow water to flow therein. The first water passage 251*a* may guide the movement of the water toward the first water receiving portion 253*a*.

The first water receiving portion 253*a* may be provided with a space in which water temporarily moving along the first water passage 251*a* is temporarily received. A plurality of water moving holes 254 may be disposed in the first water receiving portion 253*a*, and water received in the first water receiving portion 253*a* may be discharged through the water moving hole 254.

In addition, the second water receiving portion 253*b* may be disposed at a position adjacent to the first water receiving portion 253*a* to communicate with the second water passage 251*b*, thereby implementing a movement of water.

The detergent input hole 214 may be disposed at a lower center portion of the housing 201. The detergent input hole 214 may be configured to communicate with the tub (not shown) of the laundry treating apparatus 100, and thus laundry detergent mixed with water may be moved toward the detergent input hole 214 and then supplied to the tub (not shown).

Furthermore, as shown in FIG. 4A, the dispenser lid 252 may be provided to cover the dispenser cover 251. At this time, one side of the dispenser lid 252 may be disposed with a first water receiving protrusion 252*a* and a second water receiving protrusion 252*b* at positions vertically overlapping with the first water receiving portion 253*a* and the second water receiving portion 253*b* disposed at the dispenser cover 251.

The first water receiving protrusion 252*a* and the second water receiving protrusion 252*b* may be disposed to protrude upward, respectively, and configured to extend a space capable of receiving water moving along the water passage.

In addition, laundry detergent moving through the laundry detergent pump 230 from the storage container 221, 222 may move along a laundry detergent input pipe 240 disposed to extend toward an upper portion of the water dispenser 250. The first and second laundry detergent input pipes 241, 242 defining a flow of different laundry detergents may be respectively coupled to the first water receiving protrusion 252*a*.

However, although not shown in the drawing, the first laundry detergent input pipe 241 and the second laundry detergent input pipe 242 may also be coupled to the first water receiving protrusion 252*a* and the second water receiving protrusion 252*b*, respectively.

Laundry detergent may move along the laundry detergent input pipe 241, 242, and bypass an outside of the housing 201 by the laundry detergent pump 230 to be then directly injected into the storage case 210 and/or the housing 201 through the water dispenser 250.

As shown in FIG. 4B, an inclined portion 215 having a predetermined inclination may be disposed at a lower surface portion of the housing 201 to face the detergent input hole 214. The laundry detergent pump 230 may be provided at a rear portion of the housing 201 to define a movement of laundry detergent stored in the storage containers 221, 222.

A discharge port (not shown) may be disposed to protrude at a rear portion of each storage container 221, 222 so as to discharge the stored laundry detergent by the operation of the laundry detergent pump 230, and the discharge port may be coupled to the laundry detergent pump 230. Laundry detergent moving along the laundry detergent input pipe 240 through the discharge port (not shown) may be supplied to the water dispenser 250, and added together with water received in the water receiving portions 253*a*, 253*b* and mixed with each other, and then supplied to the tub (not shown) through the detergent input hole 214.

When the storage case 210 is inserted and positioned into the main body 110, the first water receiving portion 253*a* and the second water receiving portion 253*b* may be overlapped in a vertical direction with one partitioned region of the third storage container 223 provided in the manual detergent dispensing unit 223' of the storage case 210.

When liquid detergent moving along the laundry detergent input pipe 240 is put into the third storage container 223, water received in the first water receiving portion 253*a* may be mixed with the liquid detergent and then supplied to the tub while moving downward through the water moving hole 254.

When the storage case 210 is inserted into the main body 110, the second water receiving portion 253*b* may be located to overlap with another partitioned region of the third storage container 223 provided in the manual detergent dispensing unit 223' of the storage case 210 in a vertical direction.

When fabric softener is put into the third storage container 223, water and fabric softener moving downward through a plurality of water moving holes 254 disposed in the second water receiving portion 253*b* may be mixed with each other and supplied toward the tub.

The dispenser lid 252 may have a rectangular plate shape, and may be coupled to the dispenser cover 251. When the dispenser lid 252 is coupled to the dispenser cover 251, each of the water passages 251*a*, 251*b* disposed in the dispenser cover 251 may be closed.

Figure 5:
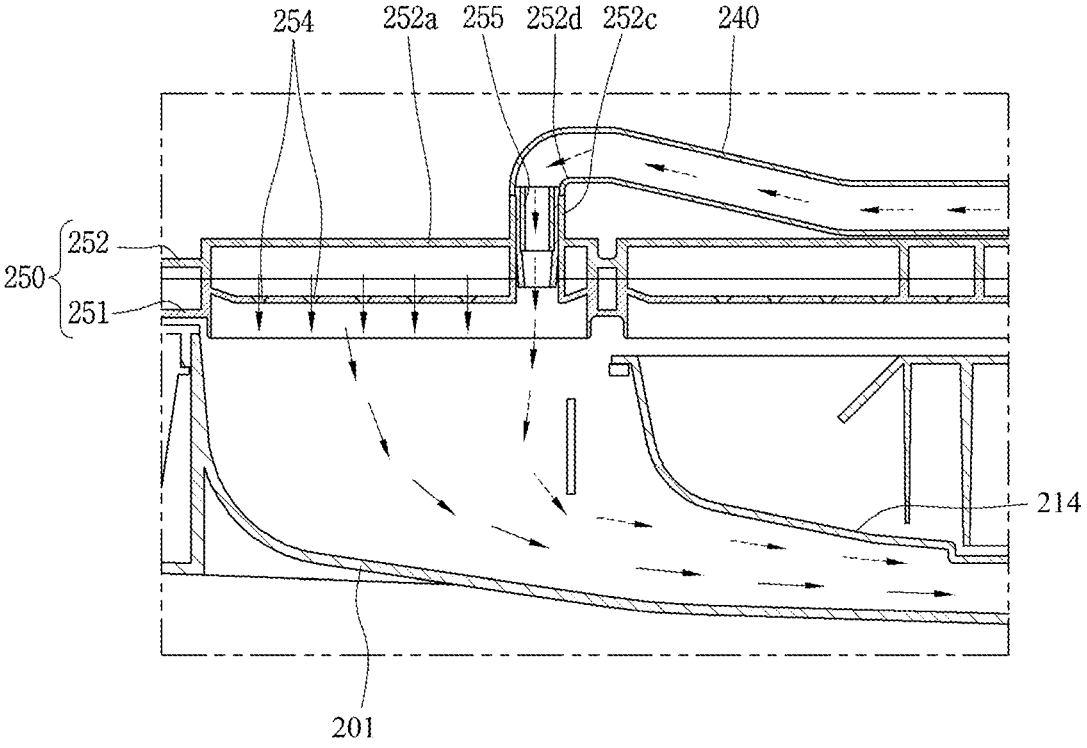
FIG. 5 is a conceptual view showing a state in which a water dispenser and a detergent input pipe are coupled to each other.

FIG. 5 is a conceptual view showing a state in which the water dispenser 250 and the laundry detergent input pipe 240 are coupled to each other.

The detergent supply apparatus 200 may include the laundry detergent input pipe 240 for moving laundry detergent being moved by the laundry detergent pump to an upper portion of the water dispenser 250.

Laundry detergent flowing out through the laundry detergent pump 230 may bypass an outside of the housing 210 along the laundry detergent input pipe 240 to be then directly injected into an inside of the storage case 210 or the housing 201 through the water dispenser 250.

At this time, as shown in FIG. 5, since the laundry detergent input pipe 240 does not communicated with a water passage disposed in the water dispenser 250, water moving inside the water dispenser 250 and water moving along the laundry detergent input pipe 240 may not be mixed with each other inside the water dispenser 250.

The laundry detergent input pipe 240 may be disposed in the shape of a pipe having a determined diameter. The laundry detergent input pipe 240 may allow laundry detergent to flow into the housing 210 through the water dispenser 250. The laundry detergent input pipe 240 may include a first laundry detergent input pipe 241 and a second laundry detergent input pipe 242 for transporting different types of laundry detergents. At this time, different laundry detergents may be allowed to efficiently flow into the storage case 210 by each laundry detergent input pipe 241, 242.

An upper one side of the dispenser lid 252 may be disposed with the water receiving protrusion 252*a* disposed to protrude so as to receive water. At this time, one end of the laundry detergent input pipe 240 may be provided to pass through the water receiving protrusion 252*a*. Furthermore, a detergent inlet portion 252*c* vertically passing through the dispenser cover 251 may be disposed at one upper side of the dispenser cover 251, and the laundry detergent input pipe 240 may be fitted and coupled to an outside of the detergent inlet portion 252*c* through a fixing mechanism (not shown) or the like.

One end of the laundry detergent input pipe 240, may be connected to the laundry detergent pump 230, and the other end thereof may be configured to communicate with an inside of the housing 210. At this time, the laundry detergent input pipe 240 may be configured to supply water being moved by the laundry detergent pump 230 toward an upper portion of the water dispenser 250. In this case, the laundry detergent input pipe 240 may be allowed to directly supply laundry detergent received in the storage container to the tub.

As such, when water moving along the laundry detergent input pipe 240 is directly injected toward an upper portion of the water dispenser 250, there is an advantage that a water supply valve for adding additional laundry detergent is not required.

The laundry detergent input pipe 240 may supply laundry detergent toward the manual detergent dispensing unit 223', and the laundry detergent may be discharged from the water dispenser 250 and mixed with water flowing into the housing 210, and then moved toward the tub.

In other words, a discharge port may be disposed at a rear portion of the storage container so that laundry detergent is discharged by the operation of the laundry detergent pump. At this time, laundry detergent moving through the discharge port may move along the laundry detergent input pipe 240 to be mixed with water flowing into the housing 210, and then move toward the tub.

Figure 6:
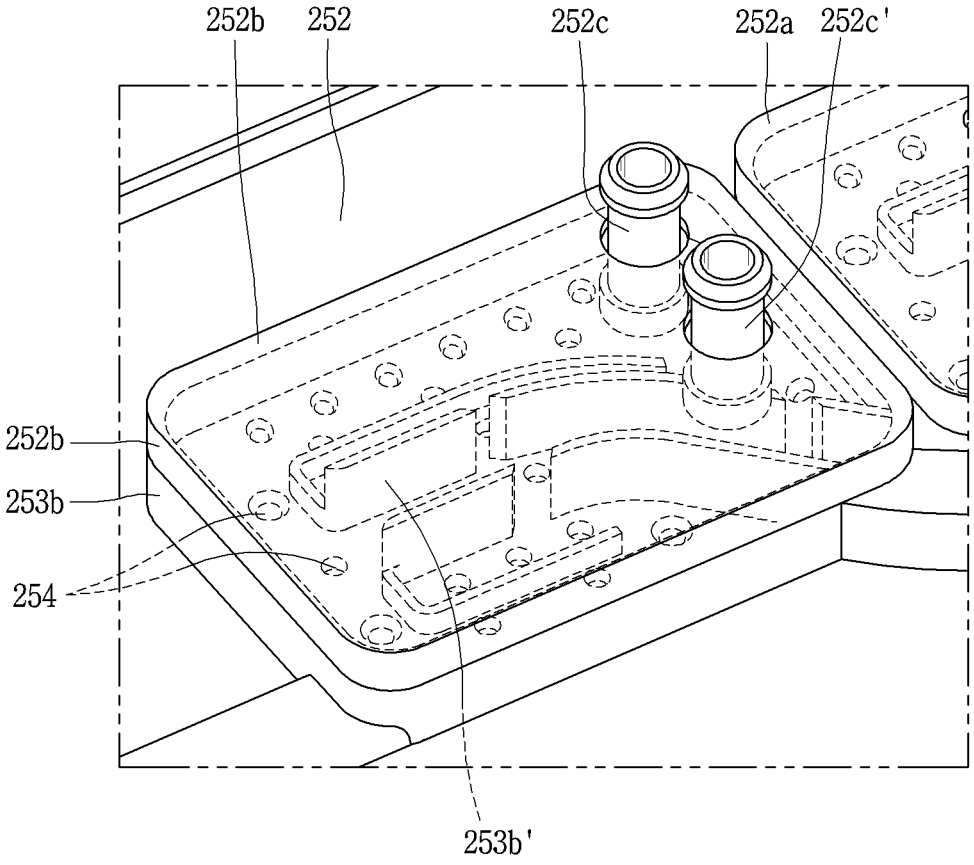
FIG. 6 is a conceptual view showing a state in which a detergent inlet portion is provided to pass through a dispenser lid and a dispenser cover.
Figure 7:
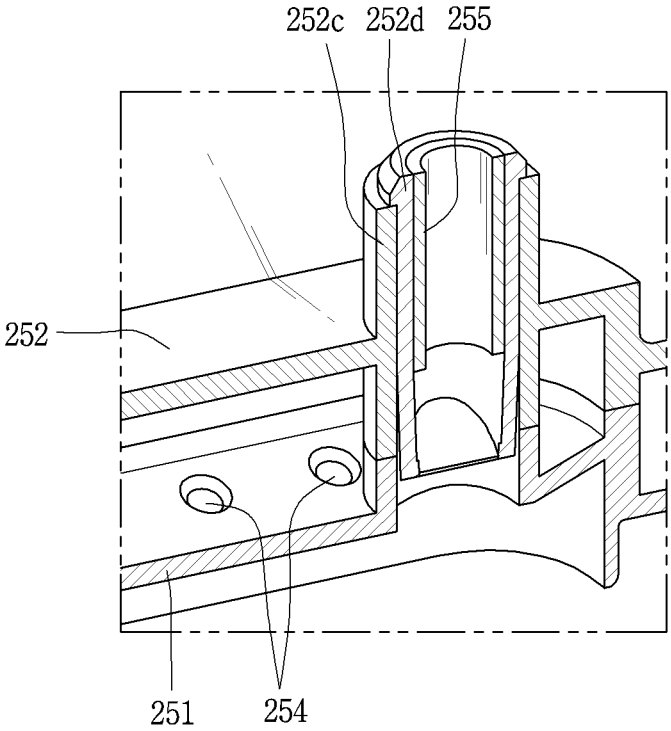

FIG. 6 is a conceptual view showing a state in which a detergent inlet portion is provided to pass through a dispenser lid and a dispenser cover, and FIG. 7 is cross-sectional view showing an inner appearance of the detergent inlet portion disposed at the dispenser lid 252, as a cross-sectional view in which FIG. 6 is cut in a transverse direction.

First and second detergent inlet portions 252*c*, 252*c'* configured to allow different laundry detergents to flow therein may be disposed at one side of the first water receiving protrusion 252*a* disposed in the dispenser lid 252. The first detergent inlet portion 252*c* and the second detergent inlet portion 252*c'* may be coupled to the first laundry detergent input pipe 241 and the second laundry detergent input pipe 242, respectively.

As shown in FIG. 7, a detergent inlet portion support member 252*d* that serves to support the detergent inlet portion 252*c* may be provided inside the detergent inlet portion 252*c*. An outer surface of the detergent inlet portion support member 252*d* may be provided to be in contact with an inner surface of the detergent inlet portion 252*c*.

In addition, a check valve 255 for preventing laundry detergent from flowing back may be provided inside the detergent inlet portion support member 252*d*. The check valve 255 may serve to define a passage to allow laundry detergent to flow only in one direction, thereby limiting laundry detergent from flowing back along the laundry detergent input pipe 240.

The foregoing description is merely embodiments for implementing a laundry treating apparatus according to the present disclosure, and the present disclosure is not limited to the above embodiments, and various modifications and improvements will become apparent to those skilled in the art without departing from the concept and scope of the present disclosure as disclosed in the following claims.

What is claimed is:

1. A laundry treating apparatus, comprising:

a main body;

a tub located inside the main body;

a drum located inside the tub and configured to rotate; and a detergent supply apparatus connected to the tub and configured to supply laundry detergent to the tub, wherein the detergent supply apparatus comprises:

a housing, a storage case configured to be inserted into the housing, a storage container disposed at the storage case and configured to receive the laundry detergent, a manual detergent dispenser disposed at the storage case and configured to accommodate the laundry detergent, a water dispenser facing the manual detergent dispenser, and a laundry detergent pump connected to the storage container and configured to move the laundry detergent in the storage container to the water dispenser, and wherein the water dispenser is configured to move, to the manual detergent dispenser, water and the laundry detergent supplied from the laundry detergent pump.

2. The laundry treating apparatus of claim 1, wherein the water dispenser is configured to move, before discharging to the manual detergent dispenser, (i) the laundry detergent through an outside of the water dispenser and (ii) water through an inside of the water dispenser.

3. The laundry treating apparatus of claim 1, further comprising:

a laundry detergent input pipe connecting the water dispenser to the laundry detergent pump, wherein the laundry detergent moves from the laundry detergent pump to the water dispenser through the laundry detergent input pipe.

4. The laundry treating apparatus of claim 3, wherein the laundry detergent pump is disposed at a rear portion of the housing.

5. The laundry treating apparatus of claim 4, wherein the laundry detergent input pipe is disposed at an outside of the housing.

6. The laundry treating apparatus of claim 4, wherein the laundry detergent input pipe extends along an upper portion of the water dispenser.

7. The laundry treating apparatus of claim 3, wherein the water dispenser defines a water passage through which the water flows.

8. The laundry treating apparatus of claim 7, wherein the water dispenser defines a water receiving portion that is connected to the water passage and that is configured to receive the water, and wherein the laundry detergent input pipe is coupled to the water receiving portion.

9. The laundry treating apparatus of claim 8, wherein the water receiving portion overlaps with the manual detergent dispenser in a vertical direction, and wherein the water dispenser is configured to move the laundry detergent and the water from the water receiving portion.

10. The laundry treating apparatus of claim 8, wherein the water receiving portion is configured to block fluid communication between the laundry detergent input pipe and the water passage.

11. The laundry treating apparatus of claim 8, wherein the water receiving portion is configured to separate the laundry detergent from the water inside the water receiving portion.

12. The laundry treating apparatus of claim 8, wherein the water receiving portion comprises a detergent portion that is connected to the laundry detergent input pipe and that is configured to separate the laundry detergent from the water in the water receiving portion.

13. The laundry treating apparatus of claim 1, wherein the water dispenser is configured to move the water through a water moving hole provided above the manual detergent dispenser.

14. The laundry treating apparatus of claim 13, wherein the water dispenser is configured to move the laundry detergent through a detergent portion that is connected to the laundry detergent pump and that passes through the water dispenser.

15. The laundry treating apparatus of claim 14, wherein the water dispenser comprises a water receiving portion in which the water is received and located above the manual detergent dispenser, and wherein the water moving hole is defined at the water receiving portion and is configured to move the water received in the water receiving portion to the manual detergent dispenser.

16. The laundry treating apparatus of claim 15, wherein the detergent portion passes through the water receiving portion and defines an opening.

17. The laundry treating apparatus of claim 16, wherein the detergent portion is spaced apart from the water moving hole and is configured to partition the laundry detergent from the water in the water receiving portion.

18. The laundry treating apparatus of claim 1, wherein the laundry detergent in the storage container moves along the laundry detergent pump, the water dispenser, the manual detergent dispenser, and the tub, sequentially.

19. The laundry treating apparatus of claim 1, wherein the housing defines a detergent input hole at a lower portion, the detergent input hole in fluid communication with the tub, and wherein the laundry detergent and the water from the manual detergent dispenser move to the tub through the detergent input hole.

20. A laundry treating apparatus, comprising:

a main body;

a tub located inside the main body;

a drum located inside the tub and configured to rotate; and a detergent supply apparatus connected to the tub and configured to supply laundry detergent to the tub, wherein the detergent supply apparatus comprises:

a housing, a storage container located in the housing and configured to receive the laundry detergent, a manual detergent dispenser located in the housing and configured to accommodate the laundry detergent, a water dispenser facing the manual detergent dispenser, and a laundry detergent pump connected to the storage container and configured to move the laundry detergent in the storage container to the water dispenser, and wherein the water dispenser is configured to move, to the manual detergent dispenser, water and the laundry detergent supplied from the laundry detergent pump.

* * * * *